US012485305B2

(12) United States Patent
Hsu

(10) Patent No.: US 12,485,305 B2
(45) Date of Patent: Dec. 2, 2025

(54) BLADE RESISTANCE ADJUSTMENT STRUCTURE AND EXERCISE MACHINE HAVING THE SAME

(71) Applicant: Chih-Yung Hsu, Tainan (TW)

(72) Inventor: Chih-Yung Hsu, Tainan (TW)

( * ) Notice: Subject to any disclaimer, the term of this patent is extended or adjusted under 35 U.S.C. 154(b) by 72 days.

(21) Appl. No.: 18/623,226

(22) Filed: Apr. 1, 2024

(65) Prior Publication Data

US 2024/0359045 A1 Oct. 31, 2024

(30) Foreign Application Priority Data

Apr. 26, 2023 (TW) ..... 112115537

(51) Int. Cl.
*A63B 21/008* (2006.01)
*A63B 21/00* (2006.01)
*A63B 22/00* (2006.01)

(52) U.S. Cl.
CPC ..... *A63B 21/008* (2013.01); *A63B 21/153* (2013.01); *A63B 22/0076* (2013.01); *A63B 2022/0079* (2013.01)

(58) Field of Classification Search
CPC . A63B 21/008; A63B 21/153; A63B 22/0076; A63B 2022/0079; A63B 21/0084; A63B 21/0088; A63B 21/00069
See application file for complete search history.

(56) References Cited

U.S. PATENT DOCUMENTS 2,041,103 A * 5/1936 Zegers ..... B63H 1/06 416/101
3,692,427 A * 9/1972 Risse ..... B01F 27/0541 415/141
3,810,712 A * 5/1974 Hillman ..... F03D 3/068 416/101
5,354,253 A * 10/1994 Awbrey ..... A63B 22/0605 482/904
7,338,257 B2 * 3/2008 Allaire ..... B60L 8/00 416/142
11,364,403 B2 * 6/2022 Hsu ..... A63B 22/0605
2004/0127117 A1 * 7/2004 McCarthy ..... A63B 31/11 441/64
2017/0274238 A1 * 9/2017 Chou ..... A63B 21/0088
2021/0244996 A1 * 8/2021 Gearon ..... A63B 21/0084
2022/0072359 A1 * 3/2022 Hsu ..... A63B 21/159

* cited by examiner

*Primary Examiner* — Garrett K Atkinson
(74) *Attorney, Agent, or Firm* — Rosenberg, Klein & Lee

(57) ABSTRACT

A blade resistance adjustment structure and an exercise machine having the same are disclosed. The blade resistance adjustment structure includes a rotating shaft, a blade seat, a plurality of blades, a sliding seat, and a plurality of connecting members. Through an adjustment force, the radius of rotation changes along with an opening and closing angle, thereby changing the magnitude of rotational resistance.

10 Claims, 10 Drawing Sheets

BLADE RESISTANCE ADJUSTMENT STRUCTURE AND EXERCISE MACHINE HAVING THE SAME

FIELD OF THE INVENTION

The present invention relates to an exercise machine, and more particularly to a blade resistance adjustment structure and an exercise machine having the same.

BACKGROUND OF THE INVENTION

A rowing exercise machine is a common exercise machine, which includes blades and a pull rope. When a user pulls the pull rope, the pull rope drives the blades to rotate, and then the blades to hit a fluid such as air or water to provide a resistance.

Chinese Patent Publication No. CN 217448885 U discloses a paddle structure and a water tank for a rowing exercise machine. The paddle structure includes blades and a shaft that drives the blades to rotate synchronously. A blade angle adjustment mechanism is provided between the blades and the shaft. The blade angle adjustment mechanism realizes the change of water resistance when the blades are rotated synchronously by adjusting the angle of each blade.

Taiwanese Utility Model Publication No. M594479 discloses a water resistance rowing exercise machine, comprising a frame, a water resistance device, blades, a pull strap and a seat. The blades may be added around the spindle to increase resistance. As long as the length of the water container does not exceed the length of the seat rod, the number of the blades can be increased to increase resistance, without increasing the overall width and the occupied space.

With regard to the adjustment of resistance, as disclosed in the aforementioned patent CN 217448885 U, the tilting angle of the blades is adjustable; as disclosed in the aforementioned patent M594479, the number of the blades is adjustable. However, both patents fail to adjust the degree of opening and closing of the blades, and the resistance adjustment in both patents is relatively limited.

SUMMARY OF THE INVENTION

According to one aspect of the present invention, a blade resistance adjustment structure is provided. The blade resistance adjustment structure comprises a rotating shaft, a blade seat, a plurality of blades, a sliding seat, and a plurality of connecting members. The rotating shaft extends in an axial direction. The blade seat is connected to the rotating shaft. The blade seat is rotated along with the rotating shaft. The blades surround the rotating shaft. The blades each include a free end and a pivot end opposite to the free end. The pivot end is pivotally connected to the blade seat. The blades each extend along a reference line between the pivot end and the free end. The blades each have a pivot portion between the pivot end and the free end. The sliding seat is slidably fitted onto the rotating shaft in the axial direction. A distance from an axis of the rotating shaft to an outermost edge of the free end on the reference line and perpendicular to the axial direction is defined as a radius of rotation. The connecting members each have one end pivotally connected to the sliding seat and another end pivotally connected to the pivot portion of a corresponding one of the blades. When the rotating shaft is driven to rotate by an external force, the blades are rotated synchronously around the rotating shaft in a fluid to obtain a rotational resistance. When the sliding seat is driven to move in the axial direction by an adjustment force, each blade is rotated with the pivot end as a fulcrum to change an opening and closing angle between the reference line and the axis, so that the radius of rotation changes along with the opening and closing angle, thereby changing the magnitude of the rotational resistance.

Preferably, the blades each include a blade body and a blade body connecting member. The blade body is fixed to one end of the blade body connecting member. Another end of the blade body connecting member is pivotally connected to the blade seat. The pivot portion is located on the blade body connecting member.

Preferably, the pivot portion is a first through hole. The connecting members each have a second through hole and a screw passing through the pivot portion and the second through hole so that the connecting members are pivotally connected to the pivot portions of the respective blades. The second through hole has a diameter substantially larger than an outer diameter of the screw.

Preferably, the fluid is a gas.

Preferably, the blade resistance adjustment structure further comprises a cover. The rotating shaft, the blade seat, the blades and the sliding seat are all arranged in the cover. The rotating shaft is rotatably connected to the cover. The cover contains the fluid. The fluid is a gas or liquid.

Preferably, the sliding seat extends out of the cover. The sliding seat has a cap at one end of the sliding seat away from the blade seat. A bearing is provided between the cap and the sliding seat. The cover has a recess corresponding to the cap. When the sliding seat moves in the axial direction, the cap is moved in or out of the recess.

According to another aspect of the present invention, an exercise machine having the foregoing blade resistance adjustment structure is provided. The exercise machine comprises a base frame, a force-applying member, a force transmitter, and an adjusting member. The blade resistance adjustment structure is disposed on the base frame. A force-applying member is movably connected to the base frame. The force-applying member is configured for receiving the external force. The force transmitter has one end connected to the force-applying member and another end directly or indirectly connected to the rotating shaft for driving the rotating shaft to rotate. The adjusting member is directly or indirectly connected to the sliding seat. The adjusting member is configured for receiving the adjustment force.

Preferably, the adjusting member is connected to the sliding seat via an adjustment transmitter. The adjustment transmitter has a plurality of connection points connected to the sliding seat. The connection points surround the rotating shaft. The base frame has at least one perforation for the adjustment transmitter to pass through the base frame.

Preferably, the exercise machine further comprises an elastic member disposed on one side of the sliding seat away from the blade seat. The elastic member has one end against the base frame and another end against the sliding seat. After the adjustment force drives the sliding seat to move away from the blade seat in the axial direction, the sliding seat and the base frame compress the elastic member, and the elastic member stores a first elastic potential energy. When the adjustment force is removed or reversely applied, the elastic member releases the first elastic potential energy, and the elastic member drives the sliding seat to move in the axial direction to reset or approach the blade seat.

Preferably, the force transmitter is fixedly wound on a reel. A scroll spring connects the reel and the rotating shaft. When the external force drives the rotating shaft to rotate through the force transmitter, the force transmitter drives the reel to twist the scroll spring, and the scroll spring stores a second elastic potential energy. After the external force is removed, the scroll spring releases the second elastic potential energy, and the scroll spring drives the reel to rotate idly relative to the rotating shaft to reset the force transmitter.

According to the above-mentioned technical features, the following effects can be preferably achieved.

1. Through the adjustment force to drive the sliding seat to move in the axial direction, the degree of opening and closing of the blades can be adjusted, and the rotational resistance can be steplessly adjusted.

2. In addition to the combination of the blade body and the blade body connecting member, the blade may have a large blade body to increase the contact area with the fluid.

3. The diameter of the second through hole is substantially larger than the outer diameter of the screw, so the connecting member drives the blade to rotate more smoothly.

4. The fluid may be a gas or liquid depending on the needs of use, in cooperation with the cover.

5. The cover has the recess to provide a sliding space for part of the sliding seat, so that the length of the rotating shaft can be shortened, thereby reducing the overall size of the cover.

6. Since the adjustment transmitter has the plurality of connection points connected to the sliding seat, in cooperation with the perforations of the base frame, the movement of the sliding seat is more stable and smooth.

7. The elastic member and the scroll spring can assist the reset of the sliding seat and the force transmitter respectively for the next operation.

DESCRIPTION OF THE PREFERRED EMBODIMENTS

Embodiments of the present invention will now be described, by way of example only, with reference to the accompanying drawings.

Figure 1:
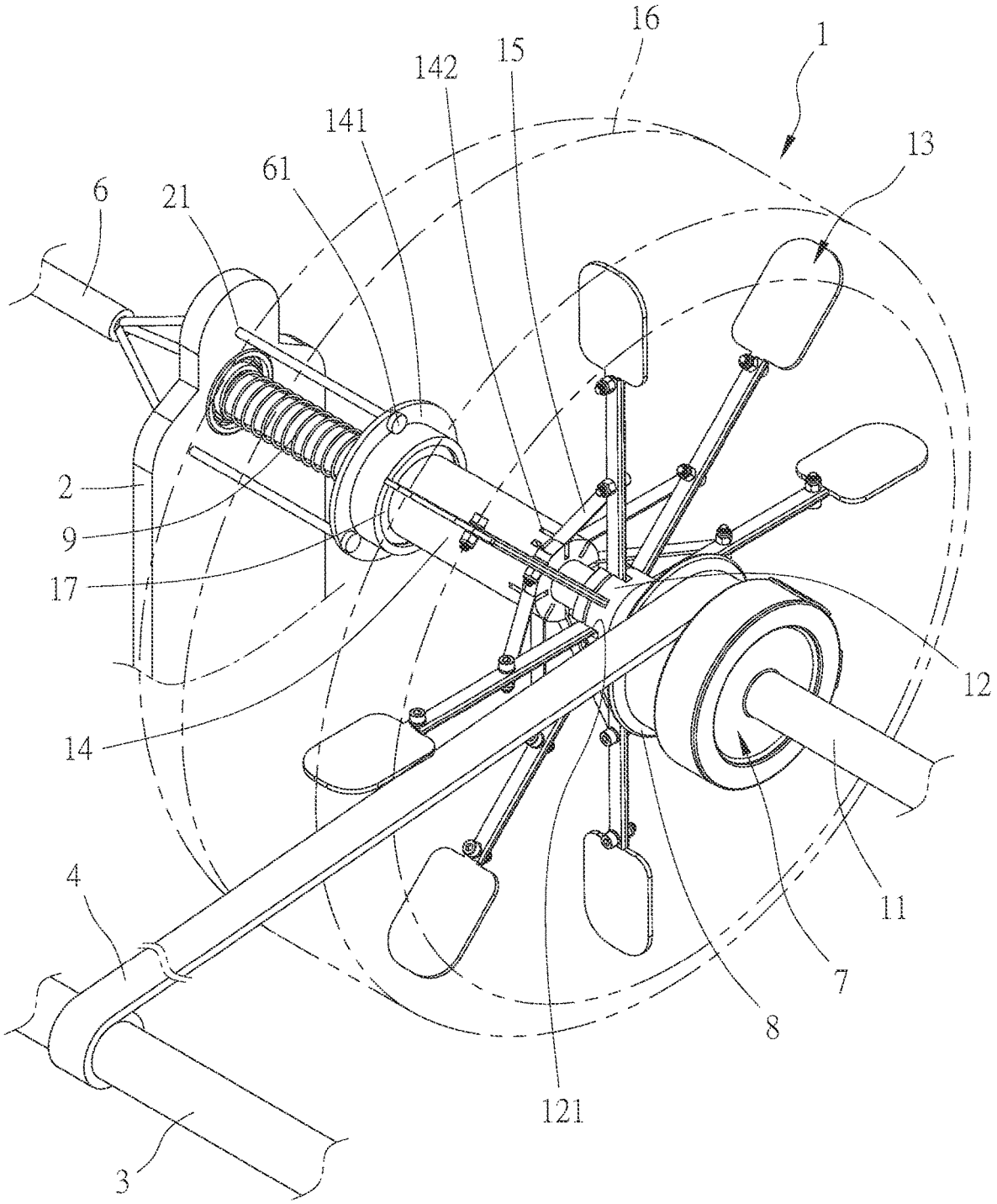
FIG. 1 is a first perspective view of a first embodiment of the present invention, illustrating the blade resistance adjustment structure.
Figure 2:
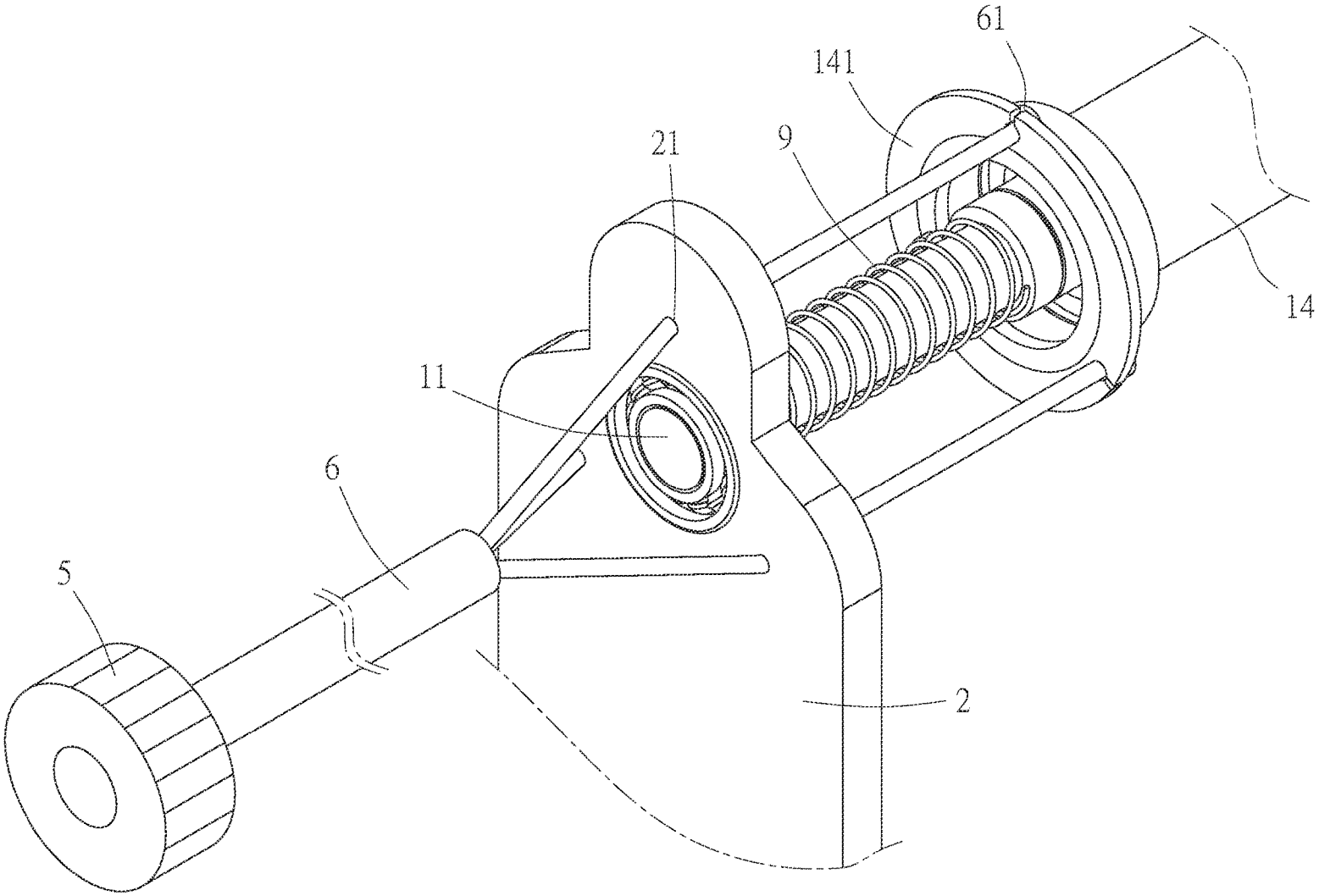
FIG. 2 is a partial enlarged view of the first embodiment of the present invention.
Figure 9:
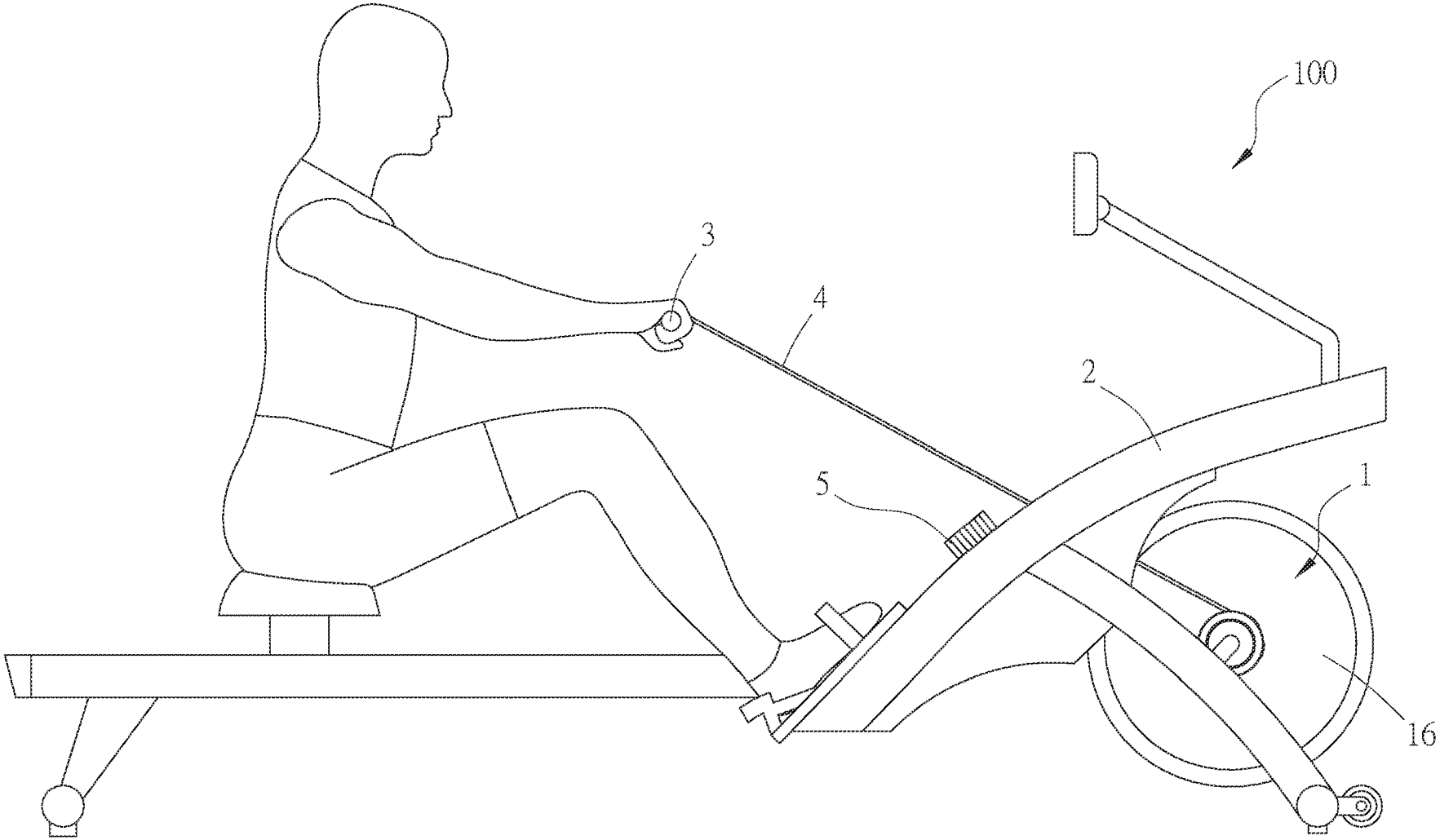
FIG. 9 is a second perspective view of the first embodiment of the present invention, illustrating the exercise machine.

The present invention discloses a blade resistance adjustment structure and an exercise machine equipment having the same. FIG. 1 and FIG. 2 illustrate a blade resistance adjustment structure 1 according to an embodiment of the present invention. The blade resistance adjustment structure 1 is disposed on an exercise machine 100 of the present invention, as shown in FIG. 9. In actual implementation, the exercise machine 100 may be a rowing exercise machine, a climbing machine, a stationary bicycle, or other equipment that requires adjustment of resistance, but not limited thereto.

The blade resistance adjustment structure 1 is disposed on a base frame 2 of the exercise machine 100. The blade resistance adjustment structure 1 comprises a rotating shaft 11, a blade seat 12, a plurality of blades 13, a sliding seat 14, a plurality of connecting members 15, and a cover 16.

Figure 5:
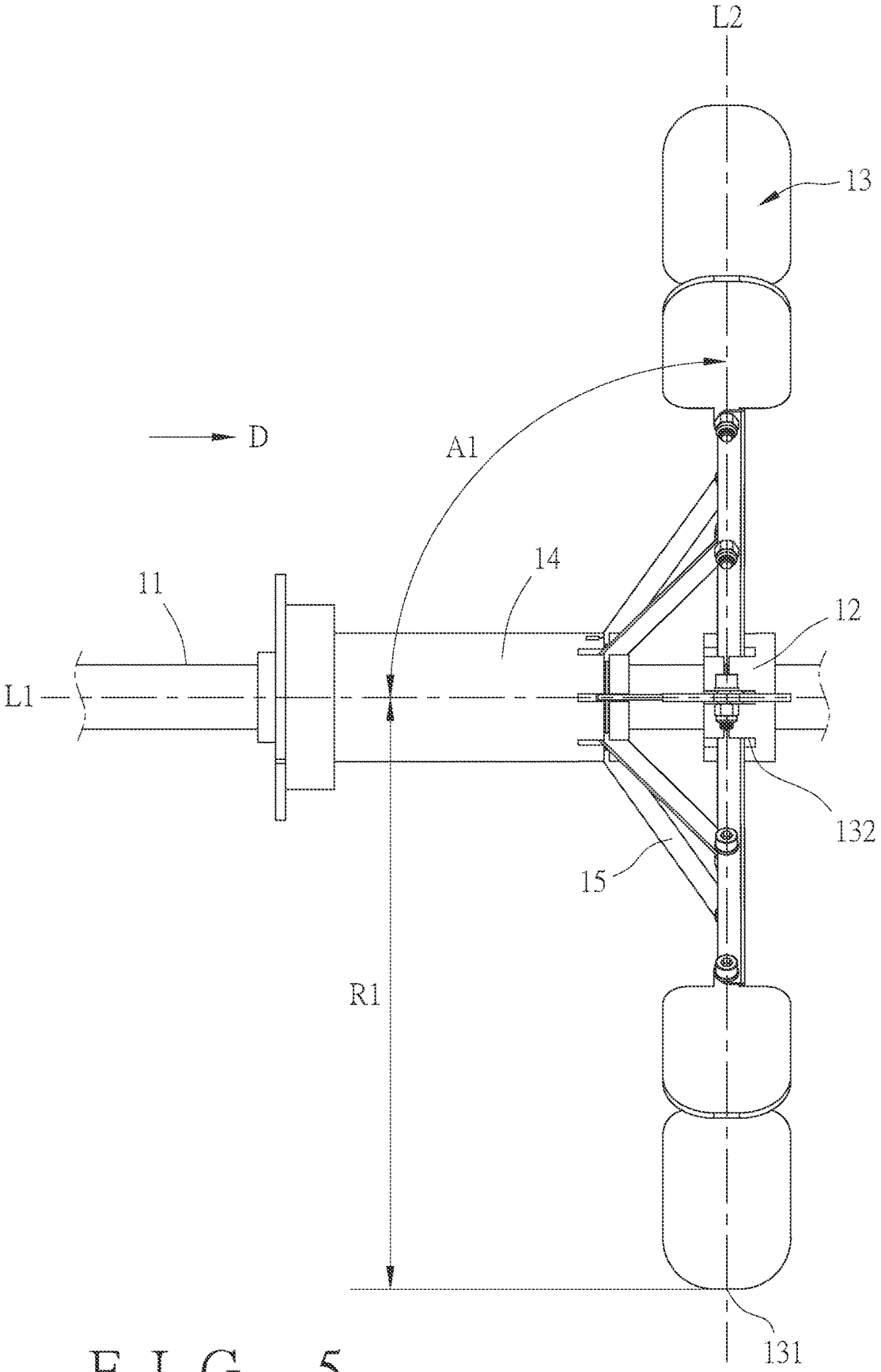
FIG. 5 is a first schematic view of the first embodiment of the present invention, illustrating that the opening and closing angle is 90 degrees.

The rotating shaft 11 extends in an axial direction D and has an axis L1 passing through the center of the rotating shaft 11 and extending in the axial direction D, as shown in FIG. 5.

The blade seat 12 is connected to the rotating shaft 11. The blade seat 12 is rotated along with the rotating shaft 11.

The blades 13 surround the rotating shaft 11.

Please refer to FIG. 2 through FIG. 5. Each blade 13 includes a free end 131 and a pivot end 132 opposite to the free end 131. The pivot end 132 is pivotally connected to the blade seat 12. Each blade 13 extends along a reference line L2 between the pivot end 132 and the free end 131. Each blade 13 has a pivot portion 133 between the pivot end 132 and the free end 131. Preferably, the pivot portion 133 is a first through hole.

Each blade 13 further includes a blade body 134 and a blade body connecting member 135. The blade body 134 is fixed to one end of the blade body connecting member 135. The other end of the blade body connecting member 135 is pivotally connected to the blade seat 12. The pivot portion 133 is located on the blade body connecting member 135.

The sliding seat 14 is slidably fitted onto the rotating shaft 11 in the axial direction D.

One end of each connecting member 15 is pivotally connected to the sliding seat 14, and the other end of each connecting member 15 is pivotally connected to the pivot portion 133 of a corresponding one of the blades 13.

Each connecting member 15 has a second through hole 151 and a screw 152 passing through the pivot portion 133 and the second through hole 151 so that each connecting member 15 is pivotally connected to the pivot portion 133. The diameter of the second through hole 151 is substantially larger than the outer diameter of the screw 152. Subsequently, the connecting member 15 drives the blade 13 to rotate more smoothly.

The rotating shaft 11, the blade seat 12, the blades 13 and the sliding seat 14 are all arranged in the cover 16. The rotating shaft 11 is rotatably connected to the cover 16. The cover 16 contains a fluid. The fluid may be a gas or liquid.

Preferably, the sliding seat 14 extends out of the cover 16. The sliding seat 14 has a cap 141 at one end of the sliding seat 14 away from the blade seat 12. The cover 16 has a recess 161 corresponding to the cap 141. When the sliding seat 14 moves in the axial direction D, the cap 141 is moved in or out of the recess 161. Since the recess 161 provides a sliding space for part of the sliding seat 14, the required length of the rotating shaft 11 outside the cover 16 can be shortened, thereby reducing the overall size of the cover 16.

In actual implementation, the cover 16 may not be provided, and the fluid may be a gas, such as air, according to actual needs.

Preferably, a bearing 17 may be provided between the rotating shaft 11 and the base frame 2, between the cap 141 and the sliding seat 14, or between other parts that may have a friction problem in the exercise machine 100 (referring to FIG. 9). In this way, when the rotating shaft 11 and the sliding seat 14 are rotated, the base frame 2 and the cap 141 won't be rotated together. The cap 141 is moved synchronously in the axial direction D along with the sliding seat 14 via the bearing 17.

Please refer to FIG. 1, FIG. 2 and FIG. 9. In addition to the blade resistance adjustment structure 1 and the base frame 2, the exercise machine 100 further comprises a force-applying member 3, a force transmitter 4, and an adjusting member 5.

The force-applying member 3 is movably connected to the base frame 2.

One end of the force transmitter 4 is connected to the force-applying member 3, and the other end of the force transmitter 4 is directly or indirectly connected to the rotating shaft 11 to drive the rotating shaft 11 to rotate.

The adjusting member 5 is directly or indirectly connected to the sliding seat 14.

In a preferred embodiment of the present invention, the adjusting member 5 is connected to the sliding seat 14 via an adjustment transmitter 6. The adjustment transmitter 6 has a plurality of connection points 61 connected to the sliding seat 14. The connection points 61 surround the rotating shaft 11. The base frame 2 has at least one perforation 21 for the adjustment transmitter 6 to pass through the base frame 2.

More specifically, the adjustment transmitter 6 may be three cables connected to the sliding seat 14 at three connection points 61, and the three cables are connected to the adjusting member 5 after being combined into one. In addition to being a knob, the adjusting member 5 may receive an adjustment force through a pin or the like.

The force transmitter 4 is fixedly wound on a reel 8. A scroll spring 7 connects the reel 8 and the rotating shaft 11.

Figure 4:
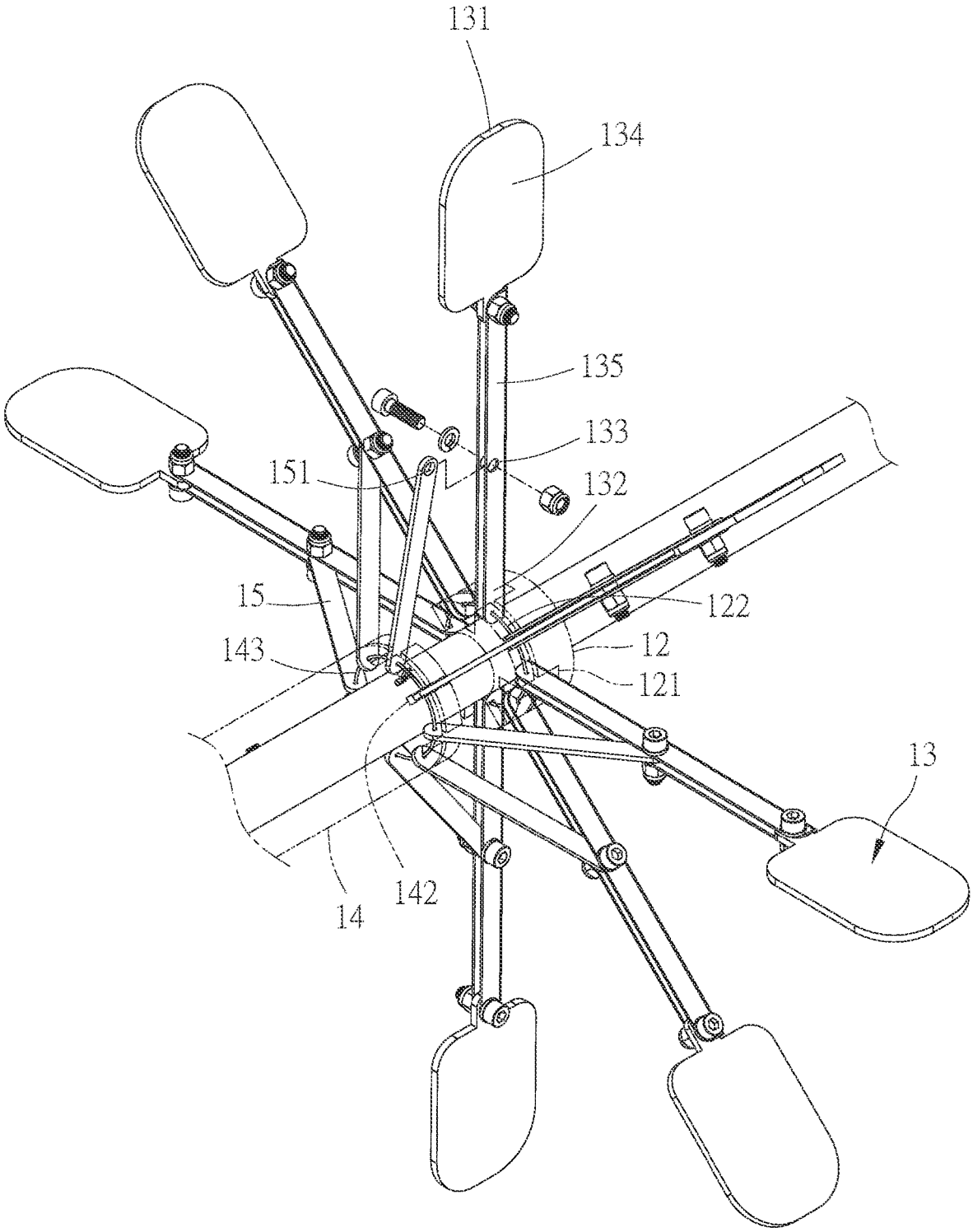
FIG. 4 is a partial exploded view of the first embodiment of the present invention.

Referring to FIG. 4, in a preferred embodiment of the present invention, the connecting member 15 is pivoted in such a way that the blade seat 12 has a plurality of first notches 121 and a first ring 122 and that the sliding seat 12 has a plurality of second notches 142 and a second ring 143. The first ring 122 and the second ring 143 pass through both ends of the connecting member 15, respectively. The connecting member 15 can be pivoted in the first notch 121 and the second notch 142. The actual implementation is not limited thereto.

Figure 3:
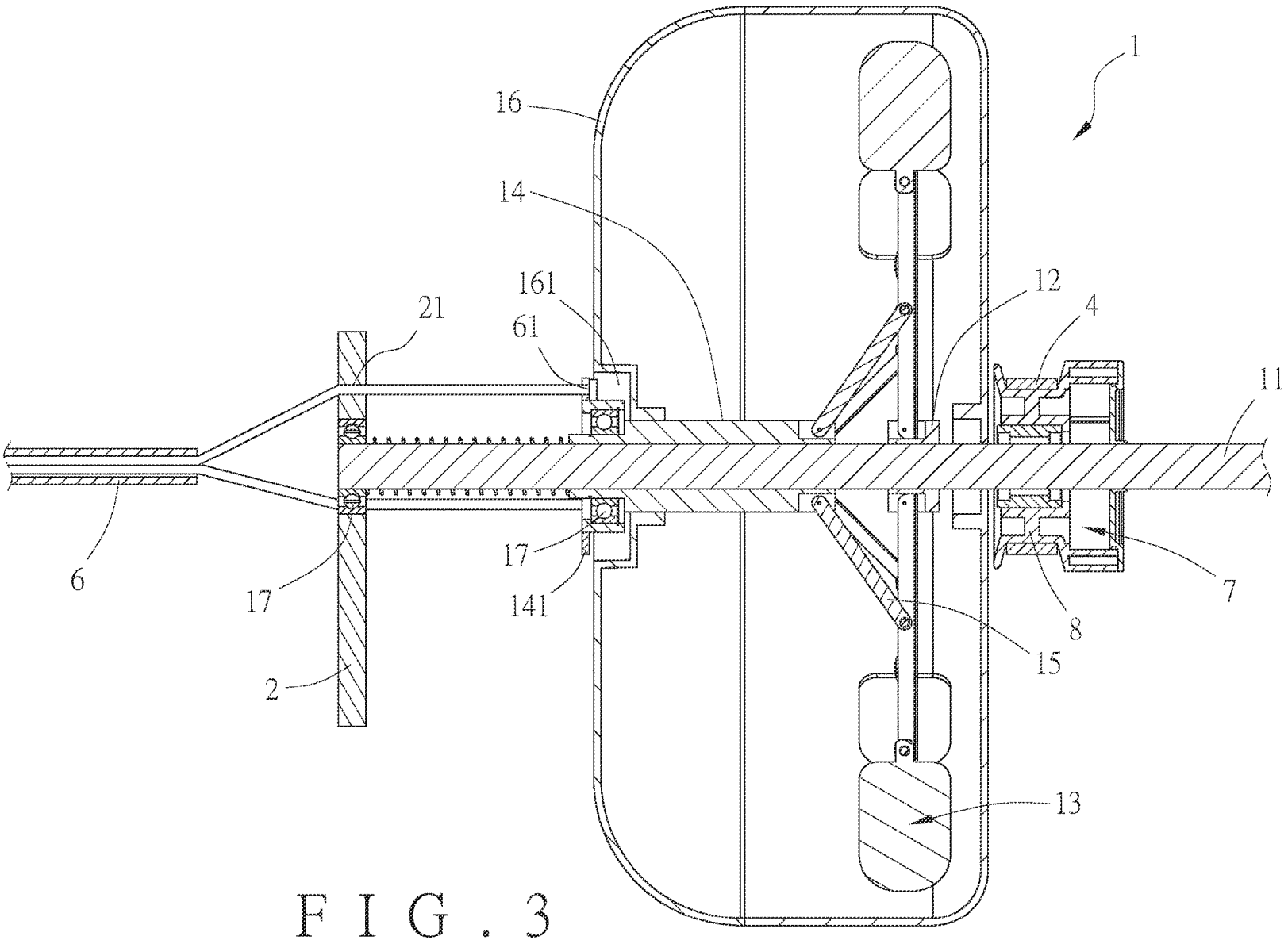
FIG. 3 is a first cross-sectional view of the first embodiment of the present invention.

Referring to FIG. 3, an elastic member 9 is disposed on one side of the sliding seat 14 away from the blade seat 12. One end of the elastic member 9 rests against the base frame 2, and the other end of the elastic member 9 rests against the sliding seat 14.

Figure 6:
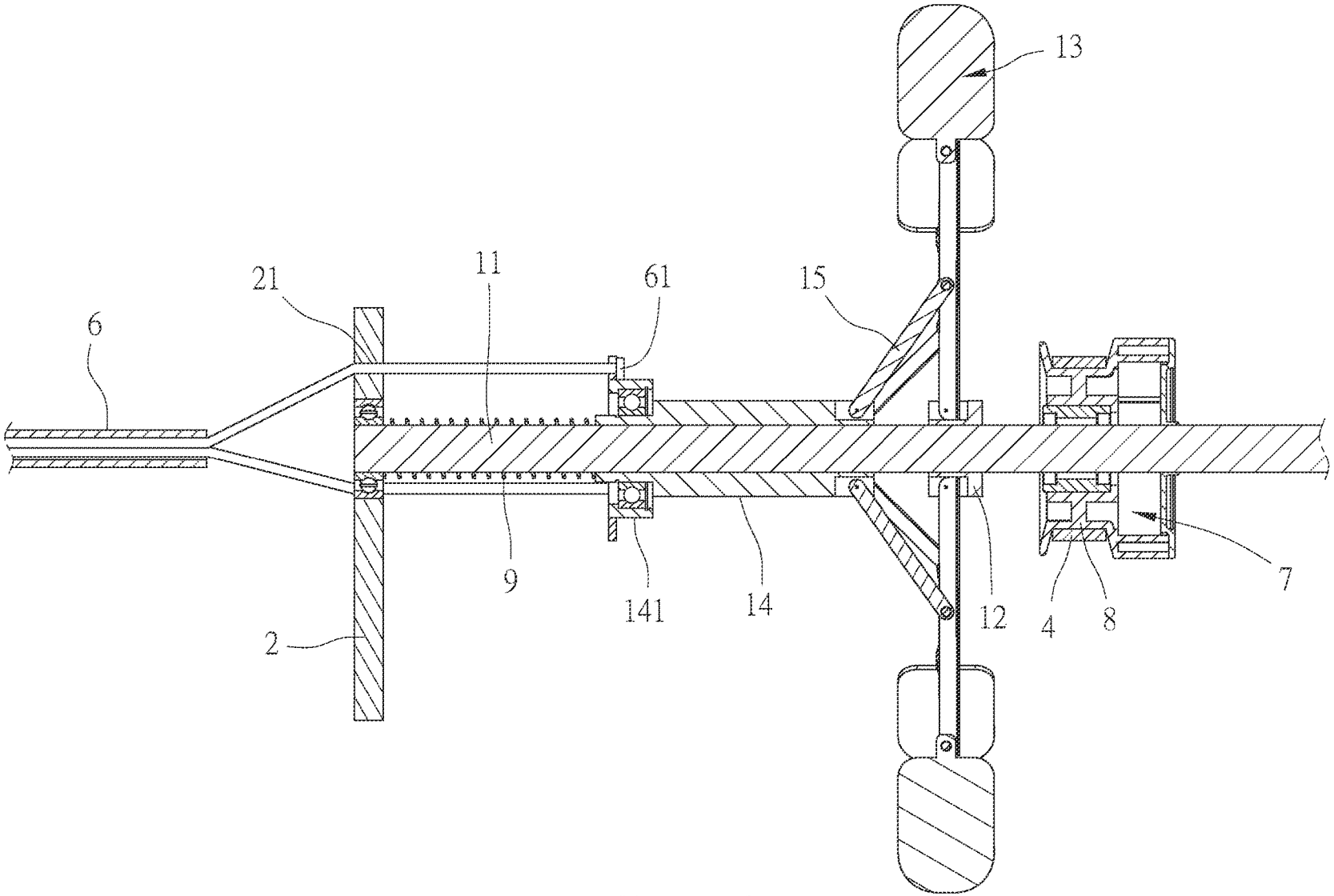
FIG. 6 is a second cross-sectional view of the first embodiment of the present invention, illustrating that when the opening and closing angle is 90 degrees, the elastic member has not yet been compressed.

Please refer to FIG. 2, FIG. 5 and FIG. 6. When the exercise machine 100 (referring to FIG. 9) is to be used, the user first adjusts the adjusting member 5 for the sliding seat 14 to be closest to the blade seat 12. At this time, an opening and closing angle A1 between the axis L1 and the reference line L2 is 90 degrees. In actual implementation, through the length of the elastic member 9, the opening and closing angle A1 is set to be 90 degrees when the adjusting member 5 has not yet received the adjustment force.

If the distance from the axis L1 to the outermost edge of the free end 131 on the reference line L2 and perpendicular to the axial direction D is defined as a radius of rotation R1, the blades 13 have a maximum of the radius of rotation R1 when the opening and closing angle A1 is 90 degrees.

Please refer to FIG. 1, FIG. 5 and FIG. 6, taking a rowing exercise machine as an example. The user stretches his/her arm to hold the force-applying member 3 and applies an external force to pull the force-applying member 3 towards the user. The external force drives the rotating shaft 11 to rotate through the force transmitter 4, and the blades 13 are rotated synchronously around the rotating shaft 11 in the fluid, such that the user will feel the maximum rotational resistance.

At this time, the force transmitter 4 drives the reel 8 to twist the scroll spring 7, and the scroll spring 7 stores a second elastic potential energy.

When the user bends his/her arms and pulls the force-applying member 3 closest to the user, holds the force-applying member 3 and stops applying the external force, the scroll spring 7 will release the second elastic potential energy. The scroll spring 7 drives the reel 8 to rotate idly relative to the rotating shaft 11 to reset the force transmitter 4. The force-applying member 3 is driven by the force transmitter 4 to move away from the user and reset, so that the user's arms are straightened again.

The user applies the external force again to pull the force-applying member 3 toward the user, stops applying the external force, and repeats this process to simulate the training action of rowing.

Figure 7:
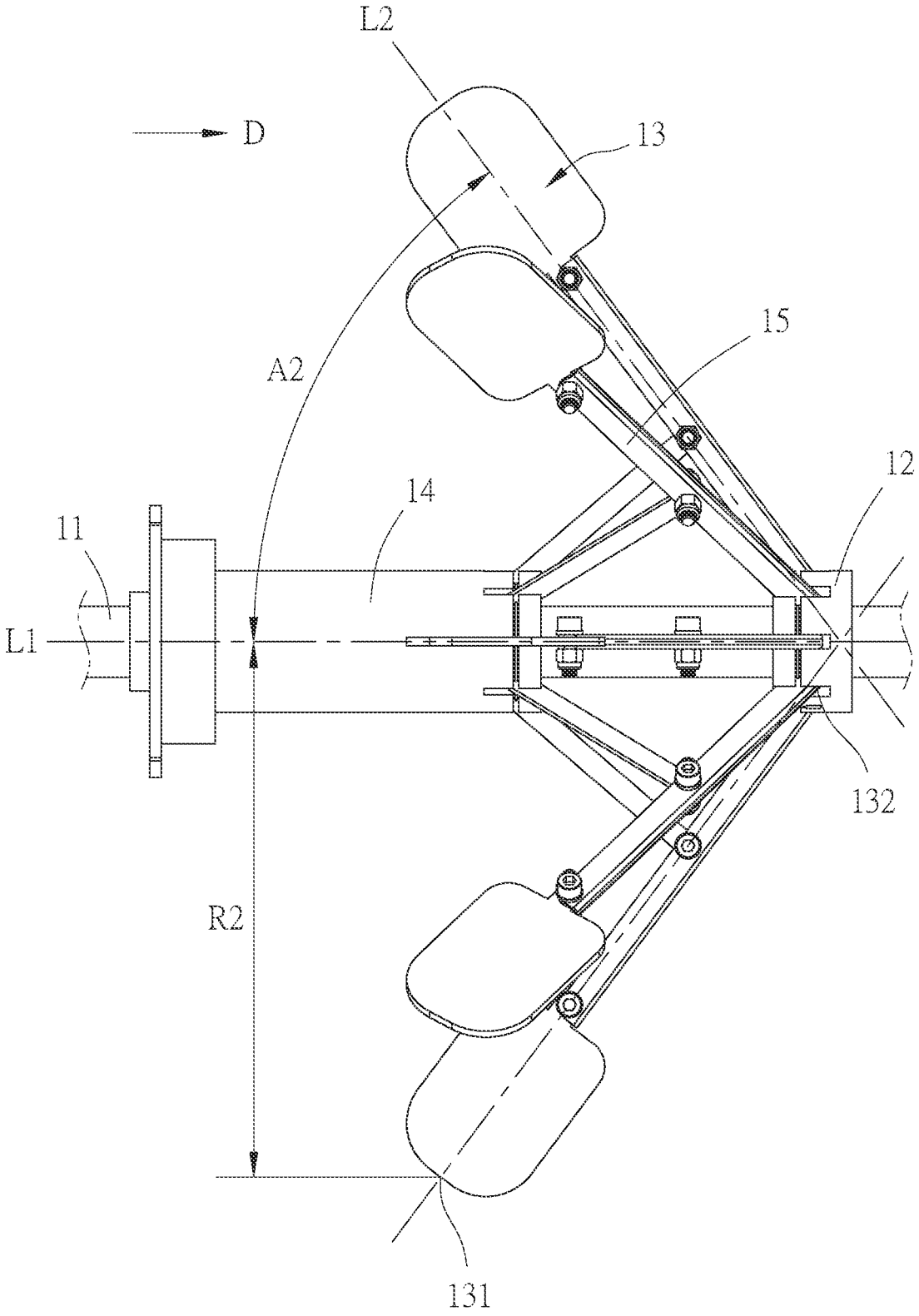
FIG. 7 is a second schematic view of the first embodiment of the present invention, illustrating that the opening and closing angle is 45 degrees.
Figure 8:
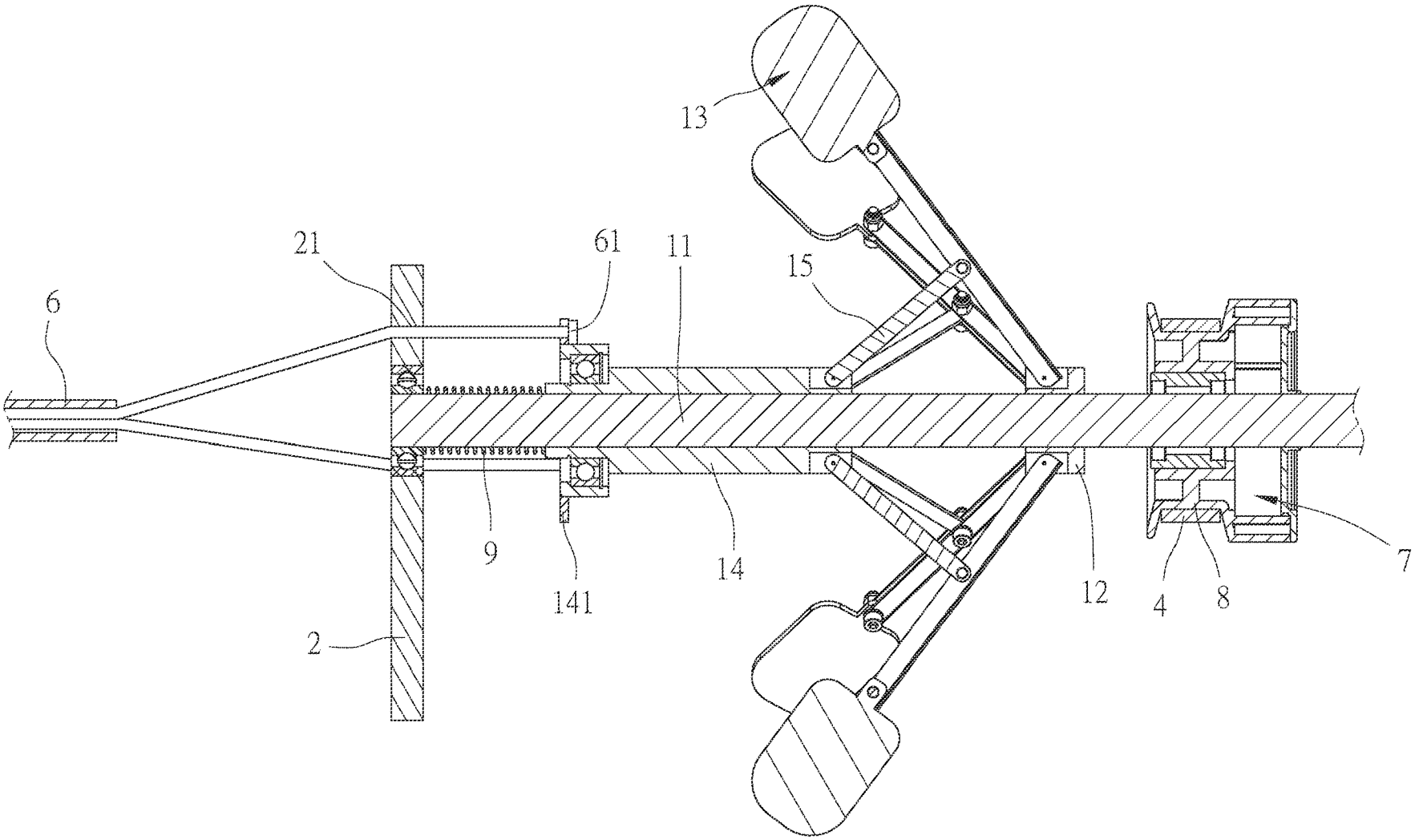
FIG. 8 is a third cross-sectional view of the first embodiment of the present invention, illustrating that when the opening and closing angle is 45 degrees, the elastic member is compressed.

Please refer to FIG. 2, FIG. 7 and FIG. 8. When the user considers that the rotational resistance when the opening and closing angle A1 as shown in FIG. 5 is 90 degrees is too large, the user can operate the adjusting member 5 to apply an adjustment force to the adjustment transmitter 6.

If the opening and closing angle A1 is 90 degrees as shown in FIG. 5, the adjustment force will drive the sliding seat 14 to move in the axial direction D away from the blade seat 12. The sliding seat 14 drives the blade 13 through the connecting member 15, so that the blade 13 rotates toward the sliding seat 14 with the pivot end 132 as a fulcrum.

Since the adjustment transmitter 6 has the plurality of connection points 61 connected to the sliding seat 14, in cooperation with the perforations 21 of the base frame 2, the movement of the sliding seat 14 is more stable and smooth.

As the user operates the adjusting member 5, the opening and closing angle A2 will gradually decrease. (The opening and closing angle A2 is adjusted to 45 degrees as shown in FIG. 7 as an example.) The radius of rotation R2 will become smaller as the opening and closing angle A2 decreases, thereby reducing the magnitude of the rotational resistance.

At this time, the sliding seat 14 and the base frame 2 jointly compress the elastic member 9, and the elastic member 9 stores a first elastic potential energy.

When the user considers that the magnitude of the rotational resistance is appropriate, the user stops operating the adjusting member 5 so that the sliding seat 14 is positioned. The user continues to do an exercise using the force-applying member 3 as shown in FIG. 1.

When the user considers that the magnitude of the rotational resistance is too small, the adjusting member 5 is rotated reversely, and the adjustment force is applied reversely. The elastic member 9 gradually releases the first elastic potential energy, and the elastic member 9 drives the sliding seat 14 to approach the blade seat 12 in the axial direction D.

In actual implementation, the adjusting member 5 may have a one-touch release function. For example, by pressing the button, the adjustment transmitter 6 is released directly, so that the elastic member 9 releases the first elastic potential energy and restores its original length, and the sliding seat 14 is reset directly to the state shown in FIG. 5 for the next operation.

Figure 10:
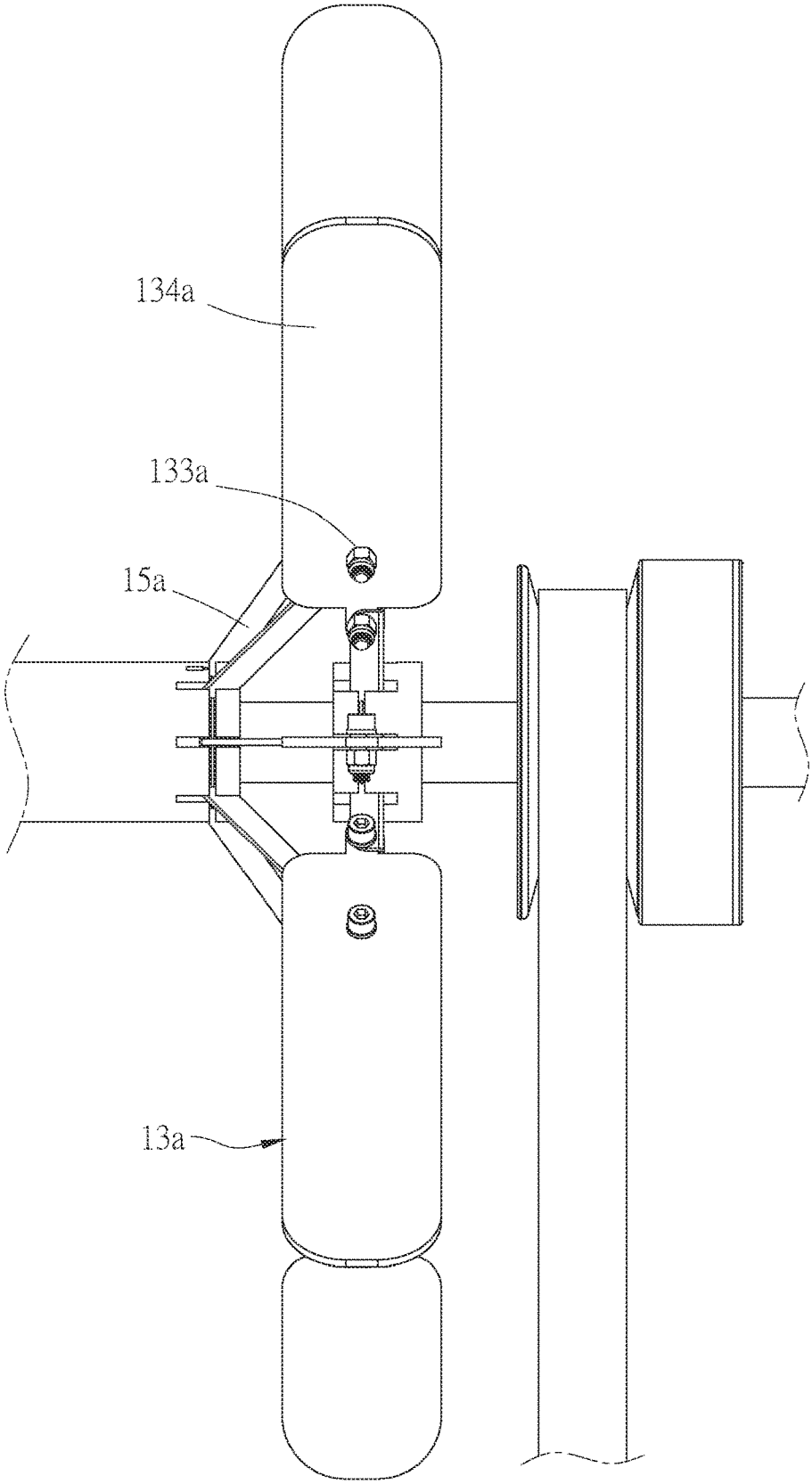
FIG. 10 is a side view of a second embodiment of the present invention.

FIG. 10 illustrates a second embodiment of the blade resistance adjustment structure of the present invention. The second embodiment is substantially similar to the first embodiment with the exceptions described hereinafter. In the first embodiment, only a small portion of the blade 13 close to the free end 131 serves as the blade body 134, as shown in FIG. 4. In the second embodiment, a large portion of the blade 13*a* serves as the blade body 134*a*, which can increase the contact area with the fluid greatly. The pivot portion 133*a* is located on the blade 134*a* and connected to the connecting member 15*a*, so that the connecting member 15*a* drives the blade 13*a* to rotate.

The rest of the structure and operation of the blade resistance adjustment structure of the present embodiment, as well as the configuration of the exercise machine, may be the same as those of the first embodiment and will not be repeated hereinafter.

Referring to FIG. 5 and FIG. 7, the sliding seat 14 is driven to move in the axial direction D by the adjustment force, so the opening and closing angles A1, A2 of the blade 13 may be steplessly adjusted. The rotational resistance is steplessly adjusted to meet the user's training needs.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A blade resistance adjustment structure, comprising:

a rotating shaft, extending in an axial direction;

a blade seat, connected to the rotating shaft, the blade seat being rotated along with the rotating shaft;

a plurality of blades, surrounding the rotating shaft, the blades each including a free end and a pivot end opposite to the free end, the pivot end being pivotally connected to the blade seat, the blades each extending along a reference line between the pivot end and the free end, the blades each having a pivot portion between the pivot end and the free end;

a sliding seat, slidably fitted onto the rotating shaft in the axial direction, wherein a distance from an axis of the rotating shaft to an outermost edge of the free end on the reference line and perpendicular to the axial direction is defined as a radius of rotation;

a plurality of connecting members, each having one end pivotally connected to the sliding seat and another end pivotally connected to the pivot portion of a corresponding one of the blades;

wherein when the rotating shaft is driven to rotate by an external force, the blades are rotated synchronously around the rotating shaft in a fluid to obtain a rotational resistance;

wherein when the sliding seat is driven to move in the axial direction by an adjustment force, each blade is rotated with the pivot end as a fulcrum to change an opening and closing angle between the reference line and the axis, so that the radius of rotation changes along with the opening and closing angle, thereby changing the magnitude of the rotational resistance.

2. The blade resistance adjustment structure as claimed in claim 1, wherein the blades each include a blade body and a blade body connecting member, the blade body is fixed to one end of the blade body connecting member, another end of the blade body connecting member is pivotally connected to the blade seat, and the pivot portion is located on the blade body connecting member.

3. The blade resistance adjustment structure as claimed in claim 2, wherein the pivot portion is a first through hole, the connecting members each have a second through hole and a screw passing through the pivot portion and the second through hole so that the connecting members are pivotally connected to the pivot portions of the respective blades, and the second through hole has a diameter substantially larger than an outer diameter of the screw.

4. The blade resistance adjustment structure as claimed in claim 1, wherein the fluid is a gas.

5. The blade resistance adjustment structure as claimed in claim 1, further comprising a cover, wherein the rotating shaft, the blade seat, the blades and the sliding seat are all arranged in the cover, the rotating shaft is rotatably connected to the cover, the cover contains the fluid, and the fluid is a gas or liquid.

6. The blade resistance adjustment structure as claimed in claim 5, wherein the sliding seat extends out of the cover, the sliding seat has a cap at one end of the sliding seat away from the blade seat, a bearing is provided between the cap and the sliding seat, the cover has a recess corresponding to the cap; when the sliding seat moves in the axial direction, the cap is moved in or out of the recess.

7. An exercise machine having the blade resistance adjustment structure as claimed in claim 1, comprising:

a base frame; the blade resistance adjustment structure being disposed on the base frame;

a force-applying member, movably connected to the base frame; the force-applying member being configured for receiving the external force;

a force transmitter, having one end connected to the force-applying member and another end directly or indirectly connected to the rotating shaft for driving the rotating shaft to rotate;

an adjusting member, directly or indirectly connected to the sliding seat, the adjusting member being configured for receiving the adjustment force.

8. The exercise machine as claimed in claim 7, wherein the adjusting member is connected to the sliding seat via an adjustment transmitter, the adjustment transmitter has a plurality of connection points connected to the sliding seat, the connection points surround the rotating shaft, and the base frame has at least one perforation for the adjustment transmitter to pass through the base frame.

9. The exercise machine as claimed in claim 7, further comprising an elastic member disposed on one side of the sliding seat away from the blade seat, the elastic member having one end against the base frame and another end against the sliding seat; wherein after the adjustment force drives the sliding seat to move away from the blade seat in the axial direction, the sliding seat and the base frame compress the elastic member, and the elastic member stores a first elastic potential energy; when the adjustment force is removed or reversely applied, the elastic member releases the first elastic potential energy, and the elastic member drives the sliding seat to move in the axial direction to reset or approach the blade seat.

10. The exercise machine as claimed in claim 7, wherein the force transmitter is fixedly wound on a reel, and a scroll spring connects the reel and the rotating shaft; when the external force drives the rotating shaft to rotate through the force transmitter, the force transmitter drives the reel to twist the scroll spring, and the scroll spring stores a second elastic potential energy; after the external force is removed, the scroll spring releases the second elastic potential energy, and the scroll spring drives the reel to rotate idly relative to the rotating shaft to reset the force transmitter.

* * * * *